United States Patent [19]

Ghesquier

[11] 4,089,732

[45] May 16, 1978

[54] INSTALLATIONS FOR THE MANUFACTURE OF BEAMS COMPOSED OF GLUED LAMINAE

[76] Inventor: Andre Jean Gerard Ghesquier, 41, avenue des Fenots, 28100 - Dreux, France, 21800

[21] Appl. No.: 689,380

[22] Filed: May 24, 1976

[30] Foreign Application Priority Data

May 27, 1975 France ..... 75 16448
May 27, 1975 France ..... 75 16449

[51] Int. Cl.[2] ..... B30B 1/30; B30B 1/38; B30B 7/04

[52] U.S. Cl. ..... 156/580; 100/208; 100/219; 100/269 R; 100/269 A; 144/256; 144/263; 144/281 R; 269/130; 269/171

[58] Field of Search ..... 156/380, 443, 559, 580, 156/512, 539; 144/256, 266, 281 A, 281 C, 281 E, 309 B, 309 Q, 315 A, 263, 265, 264; 100/137, 193, 208; 269/130, 32, 25-27, 34, 104, 108, 132, 134, 266

[56] References Cited

U.S. PATENT DOCUMENTS

| | | | |
|---|---|---|---|
| 229,198 | 6/1880 | Steinway | 144/256 |
| 1,223,568 | 4/1917 | DePoint et al. | 269/130 |
| 1,441,464 | 1/1923 | Watson | 269/130 |
| 2,331,972 | 10/1943 | Greevy | 144/256 |
| 2,355,093 | 8/1944 | Miller et al. | 144/256 |
| 2,526,987 | 10/1950 | Wilson | 100/219 |
| 2,551,383 | 5/1951 | Michaelis | 144/263 |
| 2,618,302 | 11/1952 | Rockola | 269/27 |
| 2,647,337 | 8/1953 | Martin | 100/193 |
| 3,052,921 | 9/1962 | Robinson | 269/132 |
| 3,444,029 | 5/1969 | Renaud et al. | 100/93 P |
| 3,771,438 | 11/1973 | Radakovich | 100/193 X |

*Primary Examiner*—William A. Powell
*Assistant Examiner*—M. G. Wityshyn

[57] ABSTRACT

A press for use in an installation for the manufacture of beams made of glued laminae includes an outer, vertically movable frame having a U-shaped configuration in cross section, an inner stationary frame disposed in the space between the sides of the outer frame, and a fluid operated spacer arranged between the inner and outer frame and expansible to force the bottom of the outer frame against the upper edges of the glued laminae to align the upper edges flush with one another.

8 Claims, 8 Drawing Figures

INSTALLATIONS FOR THE MANUFACTURE OF BEAMS COMPOSED OF GLUED LAMINAE

The present invention relates to improvements in or relating to installations for the manufacture of beams composed of glued laminae.

To manufacture beams of this type, installations are already known which comprise a plurality of individual presses disposed along the curve of the beam to be made and enabling previously glued laminae of wood to be pressed against one another until they have stuck. These laminae of wood are generally disposed vertically (edgewise) and it is an object of the present invention to provide a device enabling said laminae to be pressed vertically so that the edges thereof are flush with one other and to ensure a regular pressure when the beams are shaped.

To this end, the invention relates to a device for vertically pressing previously glued laminae placed in an installation comprising a plurality of individual presses disposed along the line of a beam to be made, wherein it comprises, associated with each press, two vertical pressing frames, one of which is connected to the press and the other rests on the stack of laminae, adjustable spacer means being provided between said frames whilst one of said frames serves as guide for the other.

According to another feature of the invention, the installation for making beams composed of glued laminae comprises on either side of the upright of each press, pivoting plates articulated about a vertical axis and serving as (vertical) support for said laminae.

The invention will be more readily understood on reading the following description with reference to the accompanying drawings, in which.

Figure 1:
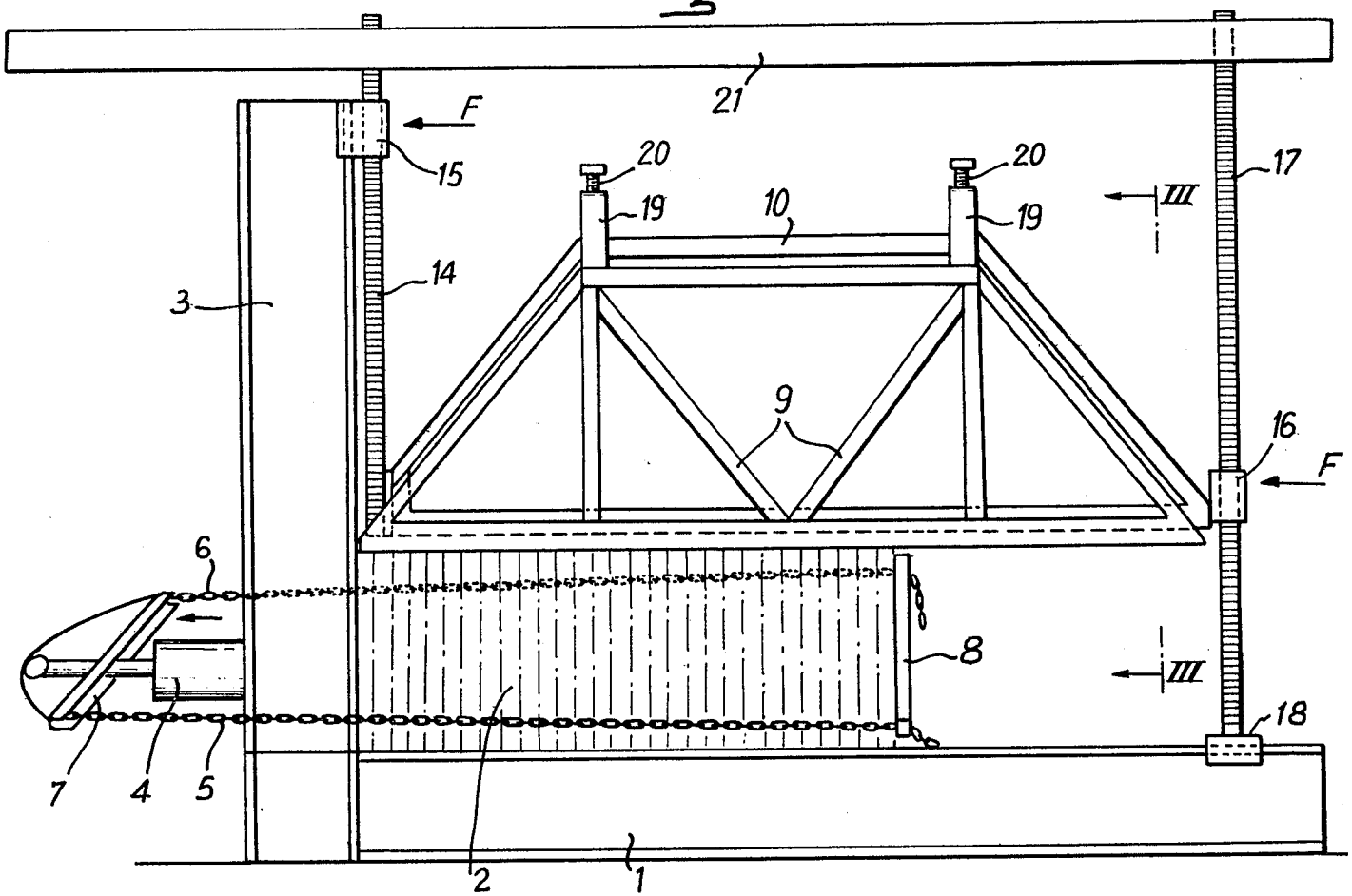
FIG. 1 shows a schematic elevational view of a press of known type, equipped with the installation according to the invention.
Figure 2:
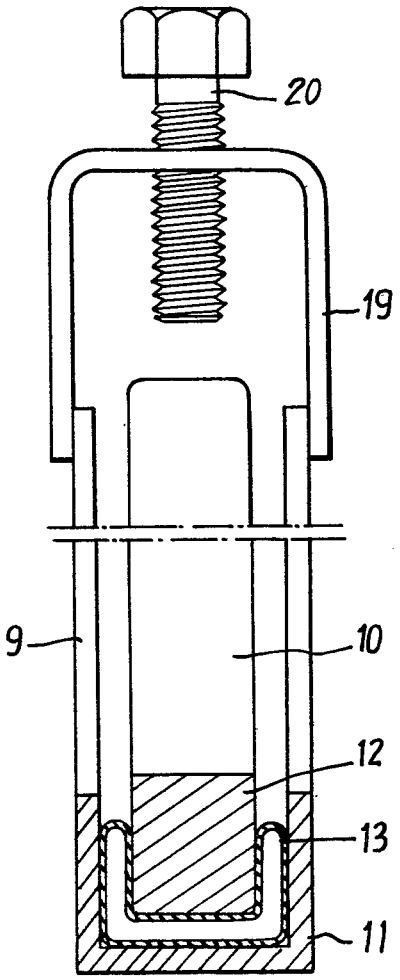
FIG. 2 illustrates the mode of fixing the fixed element of the installation according to the invention to said press.
Figure 3:
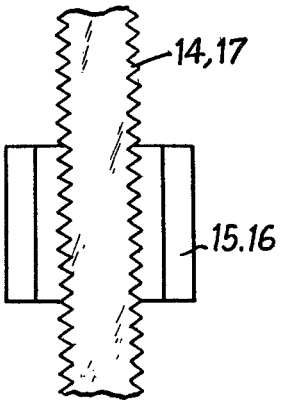
FIG. 3 is an enlarged section along line III—III of FIG. 1.

Referring now to the drawings, FIG. 1 shows a press for making beams made of glued laminae, which comprises a horizontal section on which are mounted edgewise (vertically) the laminae of wood 2 intended for forming a beam and glued prior to being positioned on the horizontal supporting section 1.

The end of said section is fast with a section 3 forming a vertical upright against which said laminae 2 are pressed under the action of a jack 4 which pulls chains 5 and 6 via a rocking lever 7, these chains at their end opposite the rocking lever 7 are fixed to a plate 8. As shown in FIG. 1, the laminae 2 are disposed vertically on the section 1 and the installation according to the invention is intended vertically to press the longitudinal edges of the different laminae 2 against the section 1 so that the upper edges of the different laminae are flush with respect to one another.

The installation according to the invention comprises a double outer frame 9, e.g. formed of welded tubes, inside which is disposed a single inner frame 10. In its lower part, the double frame 9 is formed by a U-section 11 which rests on the longitudinal upper edge of the laminae 2. Between the bottom of the U 11 and the edge 12 of substantially rectangular form of the inner frame 10 there is a tube 13 that may be inflated with compressed air. At rest, the tube 13 is flat and is substantially in the form of a U. The frames 9 and 10 are disposed transversely to the laminae 2, i.e. parallel to the section 1 and at each of its ends, the inner frame 10 is connected to said press. On the upright 3 side, the frame 10 is fast with a vertical rod 14 of square section whose two opposite side edges are provided with ribs and grooves alternately. This serrated rod 14 may cooperate with a saddle 15 that may be removably mounted on the upright 3. To this end, the saddle 15 comprises a substantially vertical rib whose side edges comprise grooves and ribs of shape corresponding to that of the rod 14. At its other end, the frame 10 comprises a saddle 16 whose constitution is substantially the same as that of saddle 15.

This saddle 16 cooperates with another vertical rod 17 whose constitution is similar to rod 14 but mounted on a slide block 18 that may slide on the upper flange of the section 1. By cooperation of the rod 14 with its saddle 15 and the rod 17 with its saddle 16, the frame 10 may therefore be removably fixed to said press. When the frames 9 and 10 are in the position shown in FIG. 1 and when compressed air is sent into the tube 14, said latter is inflated and, abutting on the frame 10 which is fixed with respect to the press, pushes the double frame 9 in the direction of the section 1. Consequently, the assembly of the frames 9, 10 acts in the manner of a jack and the frame 9 presses the edge of the laminae 2 to bring them flush with one another. In order to regulate the stroke of this jack on the one hand and on the other hand to avoid the rocking of one frame with respect to the other when the width of the beam to be made is shorter than the length of the frames 9 and 10, the frame 9 comprises in its upper part stirrup members 19 welded by their flanges to the upper part of said frame whilst threaded holes are made in their web in which are engaged screws 20. The end of these screws is capable of abutting, at the end of stroke, on the upper edge of the frame 10. In order to allow manipulation of the device 9, 10, 14, 16, 17 in one assembly, a transverse bar 21 may be provided, having notched grooves that may cooperate with the ribs and grooves of the rods 14 and 17 and engaged simultaneously with the latter.

According to the embodiment shown in FIGS. 4 to 7, the press comprises a frame provided with a horizontal support 31 resting on the ground and formed by a steel I section.

At one of the ends of this horizontal support is disposed a vertical upright 22 also composed of an I-section. On either side of the section are mounted pivoting plates 23 and 24, articulated about a vertical axis. These plates 23 and 24 are formed by angle irons whose angle is provided with upper and lower journals pivotting in cross-pieces 25 and 26 fixed to the upright 22.

A moving member 27 is mounted to slide on the upright 22 which passes through it. Screws 28 and 29 pivot freely with respect to the upright 22 and, cooperating with nuts 30 and 30*a* fast with said moving member, enable said latter to slide along the upright 22. On the side opposite the support 21, the moving member 27 is provided with a hydraulic jack 32 whose piston rod 33 carries at its end a rocking lever 34, articulated on this rod via an articulation 35. It will be noted that, due to the fact that the rod 33 may rotate about its own axis, the articulation 35 has no need to be a swivel joint but may be a simple cylindrical articulation with axis at right angles to the piston rod 33.

In the lower part of the upright 22, there is provided a base plate 36 comprising a journal 37 and a corresponding hole 38, the journal 37 and hole 38 being symmetrical with respect to the longitudinal axis of the support 31. Furthermore, the base plate 36 comprises other holes 39 for fixing it in the ground or with respect to the base plates 36 of other presses.

Figure 4:
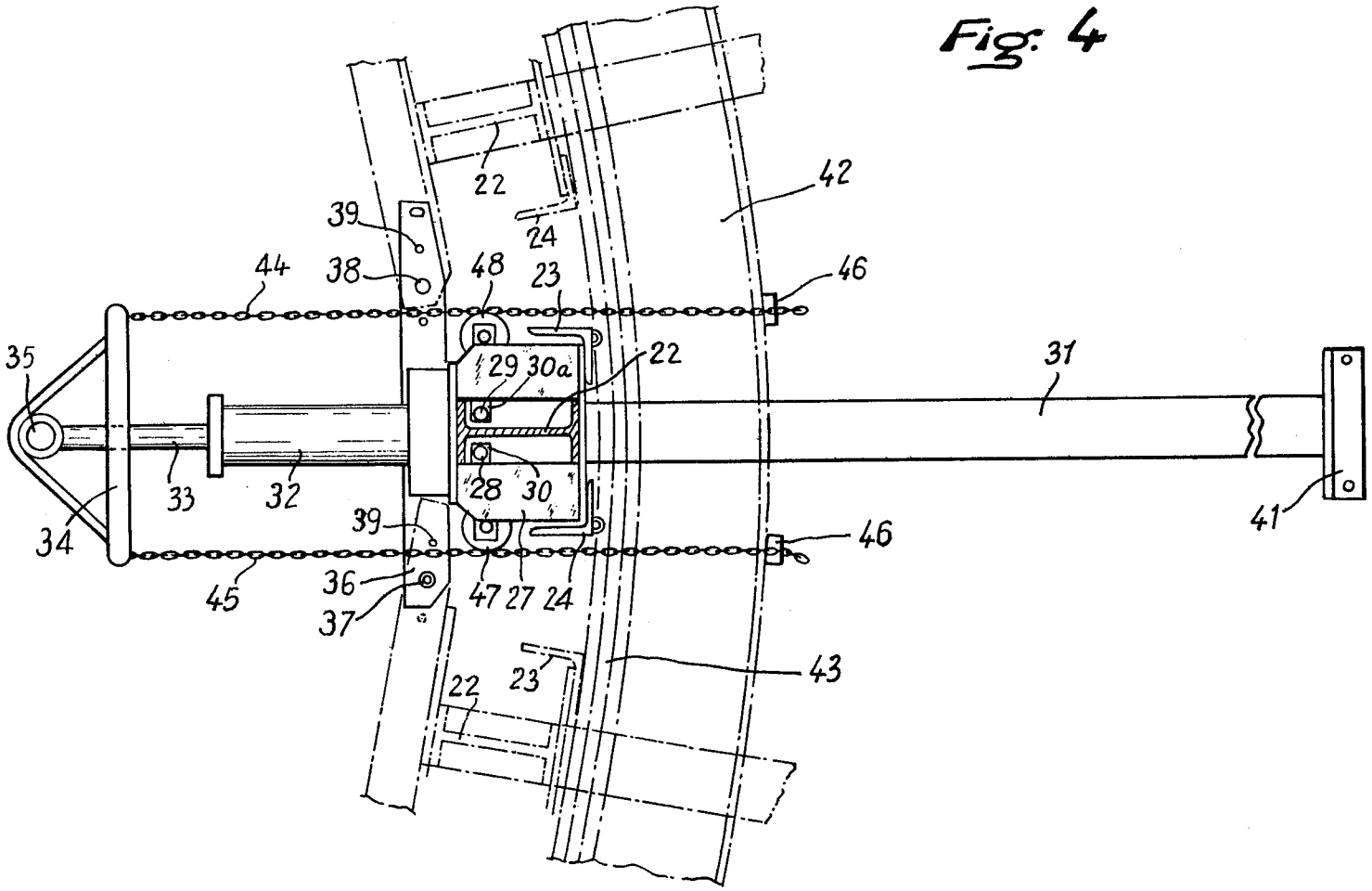
FIG. 4 is a plan view of a press according to the invention, partially in section along line IV—IV of FIG. 5.
Figure 5:
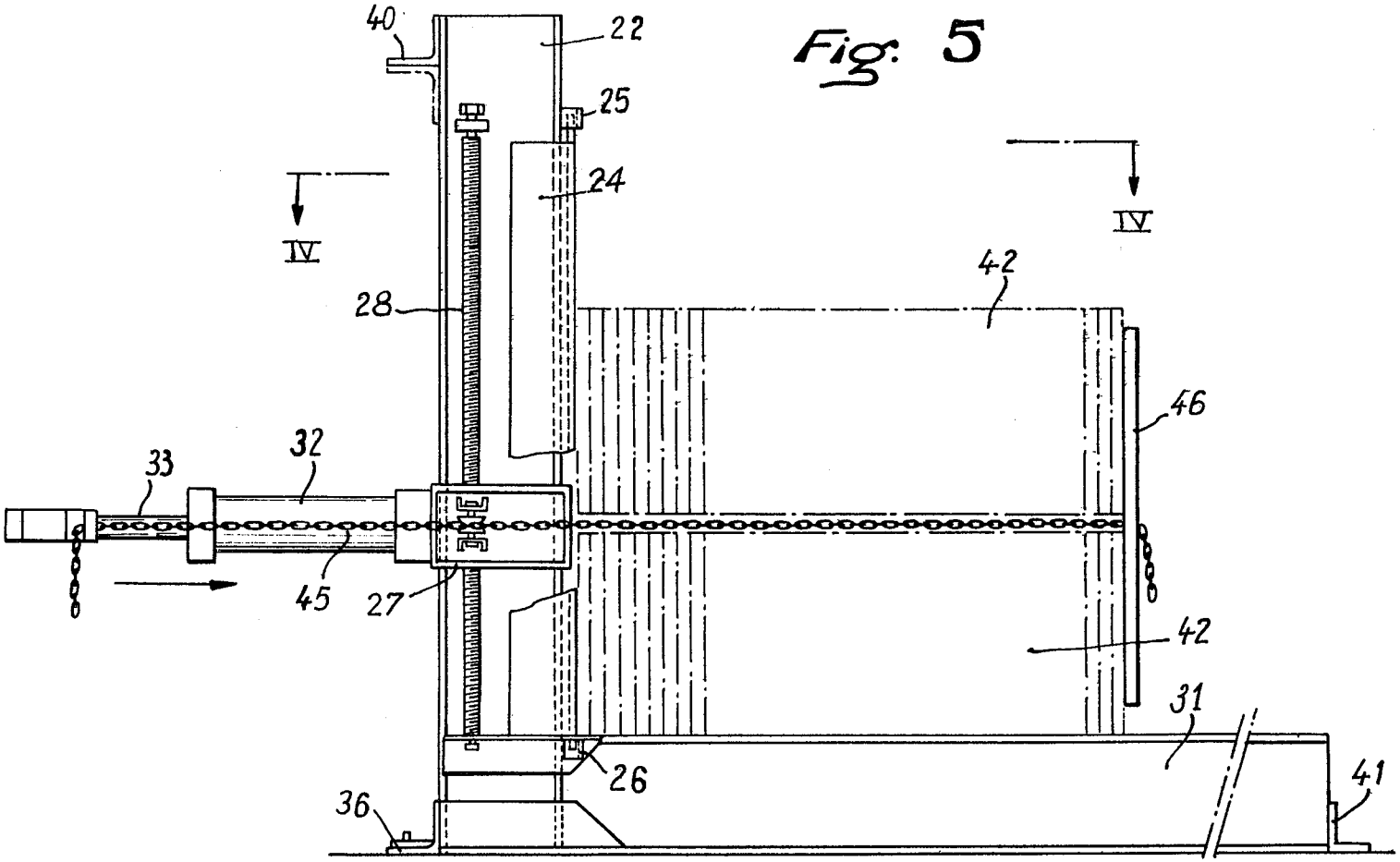
FIG. 5 is an elevation of the press of FIG. 4.
Figure 6:
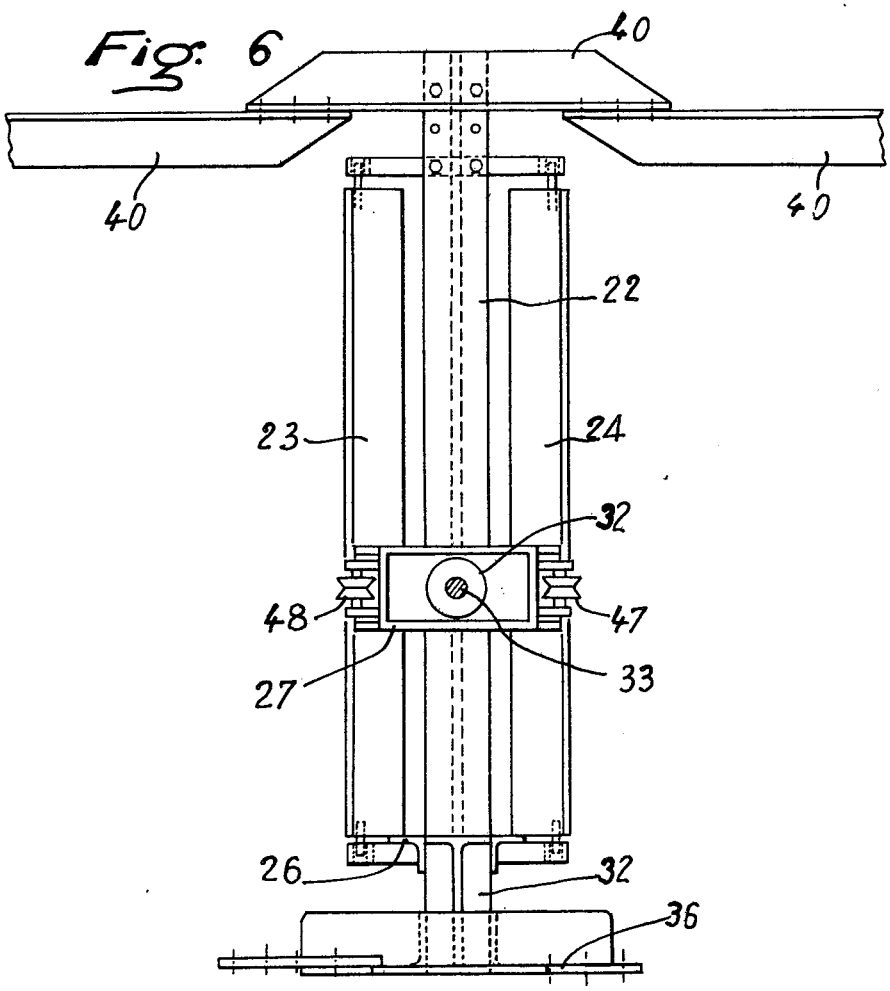
FIG. 6 is a view of the rear of the press of FIGS. 4 and 5 in the direction of arrow F 3 of FIG. 5.

In the upper part of the upright 22 is provided another plate 40 intended to cooperate with the corresponding plates of adjacent presses in order to strengthen the assembly of the presses. As shown in FIG. 4, the journal 37 of one press is engaged in the hole 38 of the base plate of an element of an adjacent press, the cooperation of said journal and said hole forming an articulation enabling any desired relative angular position to be given to the two adjacent presses. When the desired angular position is obtained, it is sufficient to fix the presses to the ground via, for example, lag screws passing through the holes 39. Thus, due to the cooperation of the base plates 36 and 40, all the presses are fast with one another, this forming a particularly rigid assembly. Squares 41 may be provided at the opposite end of the section in order to reinforce anchoring on the ground. When a plurality of similar presses shown in FIGS. 4 to 6 have been arranged, in this manner, to follow the outline of a beam 42 to be made, glued wood laminae 43 are positioned on the sections 22 and chains 44 and 45 are attached on the one hand to the ends of the rocking lever 34 and on the other hand to plates 46. In the case of only one beam 42 being manufactured at a time, the ends of the chains 44 and 45 opposite the rocking lever 34 may be connected to one plate 46 disposed obliquely with respect to the beam 42, one of the chains 44 passing above the beam, the other below.

The rocking lever 34 may have different widths according to whether the curvature of the region is more or less accentuated. When the radius of curvature is relatively small, it is the same for the rocking lever 34 and the slide block 27 may include side pulleys 47 and 48 to maintain the chains 44 and 45 in spaced apart relationship. On the other hand, when the radius of curvature of the beam is relatively large, the rocking lever 34 may be wider and at that moment the chains 44 and 45 do not abut on the pulleys 47 and 48. In the case of several beams being manufactured simultaneously, the laminae corresponding to this beam are spaced from one another by crosspieces and allow the passage of the chains 44 and 45.

When the chains 44 and 45 are fastened on the one hand to the rocking lever 34 and on the other hand to the plates 46, the hydraulic jack 32 is supplied so that its rod 33 moves in the direction opposite to section 31. This results in the chains 44 and 45 pulling the plates 46 in the direction of the section 22. Consequently, the glued laminae constituting the beams 42 are pressed against the arms of the pivoting plates 23 and 24 substantially parallel to the flanges of the section 22.

The side and front walls of the slide block 27 serve as stops for the arms of pivoting plates 23 and 24. It will be noted that, due to the fact that the pivoting plates 23 and 24 are articulated about vertical axes, they are better adapted to the curvature of the beams 42.

The hydraulic control of the assembly of the jacks 32 (not shown) enables all the jacks 32 to be controlled either simultaneously, or each individually. The simultaneous control is used for opening all the jacks, whilst the individual controls are used for individually regulating the pressure on the beams 42 at the level of each press.

Figure 7:
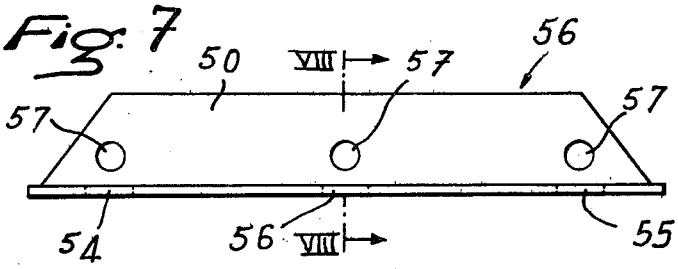
FIGS. 7 and 8 show a fastening plate according to the invention, in elevation and in section respectively.
Figure 8:
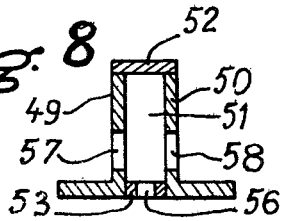

FIGS. 7 and 8 show an embodiment of the plates 46. This plate is formed by two angle irons, two arms of which are parallel and two arms are opposite. These angle irons which are referenced 49 and 50 respectively, make a space 51 which is obturated at each end by flat parts 52 and 53, the flat part 53 being in alignment with the opposite arms of the angle irons 49 and 50. The flat part 53 is pierced at its ends with holes 54 and 55 and at its centre with a hole 56, these holes allowing passage of a link of the chains 44 or 45. Furthermore, the parallel arms of the angle irons 49 and 50 are pierced with holes 57 and 58 in register, whose positions correspond to the holes 54, 55 and 56. In this way, a link of the chains 44, 45 may be introduced in a hole 54, 55 or 56, then be blocked in position by a pin passing through the corresponding holes 57 and 58. In this way, the plates 46 shown in FIGS. 7 and 8 may be used either for fixing a chain 44 or 45 at the centre of a plate or at the ends thereof.

What is claimed is:

1. A press for use in an installation for the manufacture of beams made of glued laminae comprising
   - vertical upright means having first and second sides;
   - vertical pressure plate means disposed on said first side of said upright means;
   - jack means abutting said second side of said upright means and having linking means removably attached to said pressure plate means, said jack means being operable to pull said pressure plate means toward said upright means for pressing glued laminae therebetween;
   - an outer vertically movable frame having a U-shaped configuration in cross section defining spaced vertical sides joined by a bottom adapted to rest on the upper edges of the glued laminae;
   - an inner stationary frame disposed in the space between said sides of said outer frame; and
   - fluid operated spacer means arranged between said inner and outer frames and expansible when fluid is supplied thereto to force said bottom of said outer frame against the upper edges of the glued laminae to align the upper edges flush with one another.

2. A press as recited in claim 1 wherein said inner frame has a bottom edge and said fluid operated spacer means includes an inflatable tube disposed between said bottom of said outer frame and said bottom edge of said inner frame.

3. A press as recited in claim 1 and further comprising vertically extending serrated rod means, and saddle means carried by said inner frame for engaging said rod means to lock said inner frame in a stationary position during operation of said press and to permit adjustment of the position of said inner frame.

4. A press as recited in claim 3 wherein said outer frame carries a pair of stirrup members with screws threadedly engaged therein and said inner frame has an upper edge adapted to abut said screws, said screws being adjustable to limit the relative structure of said inner and outer frames and to prevent rocking of said inner and outer frames relative to each other.

5. A press as recited in claim 4 and further comprising pivoting plates disposed on opposite sides of said upright means and articulated about vertical axes to serve as a vertical support for the glued laminae.

6. A press as recited in claim 5 wherein said jack means includes a moving member slidable along said upright means, a cylinder mounted on said moving member, a rod extending from said cylinder and a rocking lever carried at the end of said rod and coupled with said linking means, said moving member being substantially parallelepipedic in configuration with said upright means passing through the center thereof and said moving member having a front face serving as a stop for said pivoting plates.

7. A press as recited in claim 6 wherein each of said pivoting plates is formed by an angle iron having one arm disposed opposite said front face of said moving member and another arm disposed opposite a side of said moving member.

8. A press as recited in claim 7 wherein said jack means includes pulleys mounted on said moving member to receive said linking means coupled with said locking lever.

* * * * *